US007059013B2

(12) United States Patent
Wydra et al.

(10) Patent No.: US 7,059,013 B2
(45) Date of Patent: Jun. 13, 2006

(54) FLUID RECOVERY DEVICE

(75) Inventors: Larry D. Wydra, Plymouth, MN (US); David E. Bros, Saint Louis Park, MN (US)

(73) Assignee: Tennant Company, Minneapolis, MN (US)

( * ) Notice: Subject to any disclaimer, the term of this patent is extended or adjusted under 35 U.S.C. 154(b) by 255 days.

(21) Appl. No.: 10/236,746

(22) Filed: Sep. 6, 2002

(65) Prior Publication Data

US 2004/0045118 A1 Mar. 11, 2004

(51) Int. Cl.
*A47L 11/30* (2006.01)

(52) U.S. Cl. ..... 15/345; 15/322

(58) Field of Classification Search ..... 15/320, 15/322, 345, 346, 415.1; 134/21
See application file for complete search history.

(56) References Cited

U.S. PATENT DOCUMENTS

| | | | | | |
|---|---|---|---|---|---|
| 1,383,455 | A * | 7/1921 | Farnsworth | ..... | 15/346 |
| 1,383,456 | A * | 7/1921 | Farnsworth | ..... | 15/346 |
| 2,224,202 | A * | 12/1940 | Smellie | ..... | 15/346 |
| 2,635,277 | A * | 4/1953 | Belknap | ..... | 15/322 |
| 4,227,316 | A * | 10/1980 | Schneider | ..... | 34/618 |
| 4,488,329 | A | 12/1984 | Lackenbach | ..... | 15/322 |
| 4,751,759 | A * | 6/1988 | Zoell | ..... | 15/1.51 |
| 5,263,224 | A * | 11/1993 | Lovelady | ..... | 15/353 |
| 5,634,238 | A * | 6/1997 | McCaffrey et al. | ..... | 15/353 |
| 6,173,473 | B1 * | 1/2001 | Miwa | ..... | 15/345 |
| 6,353,964 | B1 * | 3/2002 | Andrisin et al. | ..... | 15/387 |
| 2002/0083549 | A1 * | 7/2002 | Deiterman et al. | ..... | 15/320 |
| 2002/0162187 | A1 * | 11/2002 | Keller | ..... | 15/345 |
| 2003/0014829 | A1 * | 1/2003 | Wang | ..... | 15/320 |

* cited by examiner

*Primary Examiner*—Terrence R. Till
(74) *Attorney, Agent, or Firm*—Fulbright & Jaworski L.L.P.

(57) ABSTRACT

An apparatus and method for extracting soiled cleaning solution from carpets and other surfaces utilizing a low-profile pick-up head is disclosed. The apparatus includes a vacuum chamber or enclosed space positioned in a fluid recovery device to provide a uniform vacuum along the entire width of the device. Also disclosed is a low-profile push-pull fluid recovery device which includes a positive pressure chamber and a vacuum chamber in the push-pull head to distribute positive and vacuum pressures, respectively, along the width of the push-pull head. Methods for using such pick-up heads are also disclosed.

21 Claims, 11 Drawing Sheets

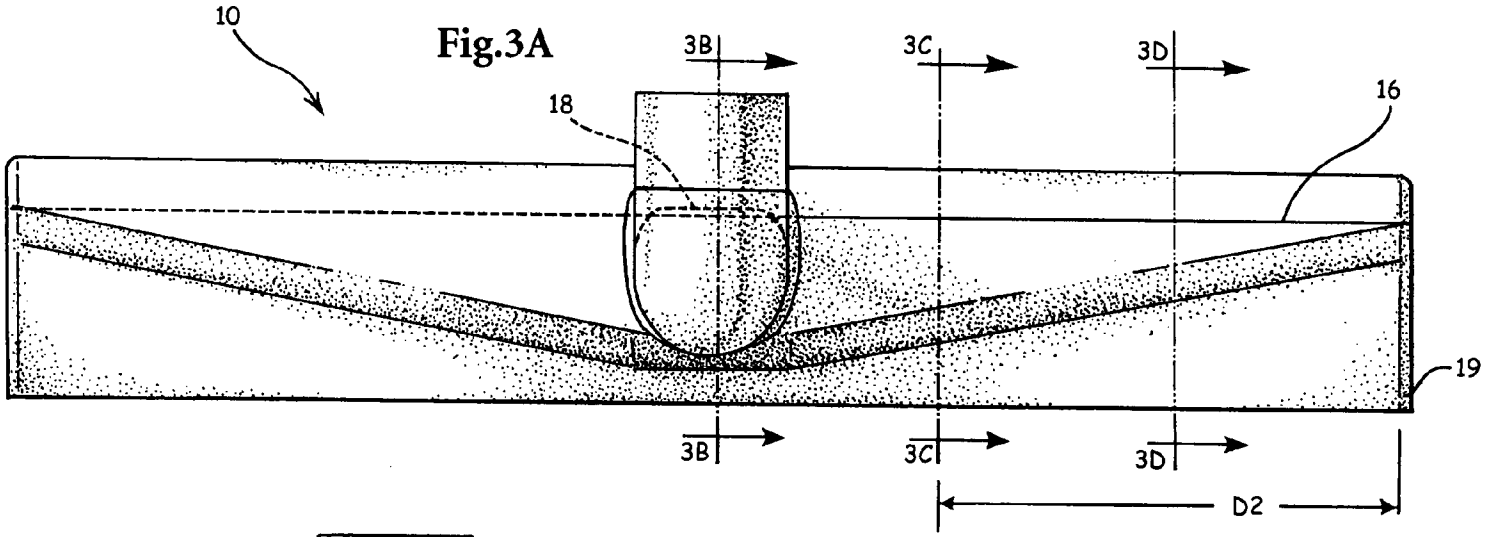
Fig.3A
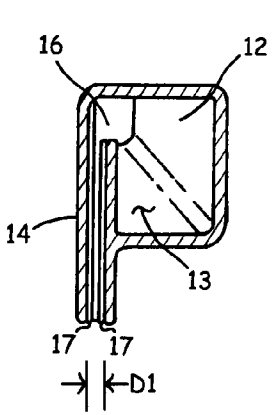
Fig.3D
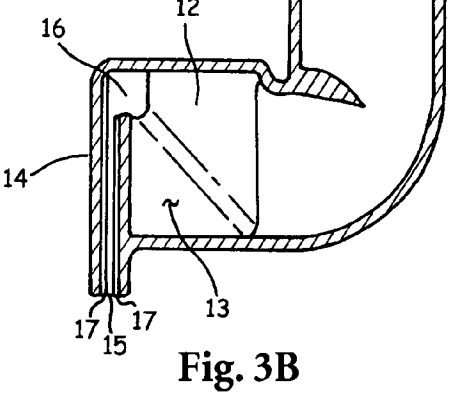
Fig. 3C
Fig. 3B 20
22
23
24
25
29
30
32
34
35
36
B
C
D

FLUID RECOVERY DEVICE

FIELD OF THE INVENTION

The present invention is directed to floor surface maintenance systems, and especially to the maintenance of carpeted areas by using such maintenance systems.

BACKGROUND OF THE INVENTION

In general, proper carpet maintenance involves regular vacuuming and periodic cleaning to remove soil by methods such as hot water extraction, shampooing, bonnet cleaning, foam cleaning, etc. Some of the soil is loosely found between carpet fibers while other soil is held upon the carpet fibers by some means such as electrostatic forces, van der Waals forces, or oil bonding. Still other soil is mechanically trapped by carpet fibers. Regular vacuuming is essential as it removes some of the loose soil that damages the fibers. Vacuuming maintains the surface appearance of a carpet and keeps the level of soil in the pile at an acceptable level. Vacuuming removes only particulate soil and some unbound or loosely bound surface dirt; therefore, other methods of cleaning are periodically required to improve the appearance of the carpet. Wet cleaning methods are better for removing oils, greases, bound dirt, and other forms of matter that cause soiling on carpet. These methods are often used by professional cleaners and trained personnel.

One type of surface maintenance machine intended for carpet cleaning is referred to as an "extractor machine." Extractor machines are commonly used for deep carpet cleaning. In general, an extractor is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Generally, in the extraction process a relatively large quantity of cleaning liquid is applied on the carpet. While the vacuum system recovers a portion of the applied cleaning liquid, a significant portion is retained by the carpet. As a consequence, carpet drying times are substantially longer than in other cleaning processes, such as a bonnet cleaning process.

Excessive carpet wetting may promote the growth of fungus and/or bacteria within the carpet. Additionally, carpet overwetting may cause surface stains to appear or reappear as underlying soil or stains migrate from the bottom of the carpet to its surface. Extractors are generally limited to a single operational direction as the steps of wetting, agitation, and vacuuming are sequentially performed. As a result, extractor machines may be difficult to maneuver in some environments, i.e., complex floor layouts. Another common problem with known extractors includes soiled solution suspended in the extractor head. Upon deactivation of the vacuum, the suspended soiled solution in the extractor head drops out of the head and may stain or leave an excessively wet mark. Yet another problem with extractors is that the vacuum pressures are not evenly distributed along the width of the nozzle, resulting in uneven soiled solution extraction.

Another problem associated with extractors is that the extractor pick-up nozzle must generally have a high profile in order to provide a sufficiently uniform vacuum across its width. This geometry makes the system somewhat unwieldy and difficult to use in small or tight spaces.

There is a need, therefore, for a extractor head that overcomes these problems and can efficiently and effectively remove soiled solution from carpeted areas.

SUMMARY OF THE INVENTION

The present invention is directed to an extractor head finding particular use with known carpet extractor machines. The extractor head includes a low-profile pick-up head. The pick-up head includes an enclosed area, a pick-up nozzle in fluid communication with the enclosed area, and an outlet orifice located on the enclosed area and spaced away from the pick-up nozzle. A vacuum source is positioned in fluid communication with the outlet orifice, and is capable of applying a partial vacuum in the enclosed area and the pick-up nozzle so that when the pick-up head is in contact with a carpet fluid is removed from the carpet.

The present invention is also directed to a push-pull extractor head for use with known carpet extractors. The push-pull pick-up head includes a first enclosed area, an exhaust nozzle in fluid communication with the first enclosed area; and an inlet orifice located on the first enclosed area and spaced away from the exhaust nozzle. The pick-up head also includes a second enclosed area positioned proximate to the first enclosed area; a pick-up nozzle in fluid communication with the second enclosed area; and an outlet orifice located on the second enclosed area and spaced away from the pick-up nozzle.

In one embodiment of the push-pull extractor head, a blower is positioned to be in fluid communication with the inlet orifice of the first enclosed area and a vacuum source is positioned to be in fluid communication with the outlet orifice of the second enclosed area. The blower is capable of pressurizing the first enclosed area and the exhaust nozzle and the vacuum source is capable of providing a partial vacuum in the second enclosed area and the pick-up nozzle when the pick-up head is in contact with a carpet or other surface.

The present invention also includes methods for extracting cleaning solution from carpets or other surfaces using extractors or dryers equipped with pick-up heads as described above.

BRIEF DESCRIPTION OF THE DRAWINGS

FIG. 3A is a front view of the pick-up head shown in FIG. 1.

FIG. 3B is a cross-sectional view of the pick-up head shown in FIG. 3A, taken along line B–B'.

FIG. 3C is a cross-sectional view of the pick-up head shown in FIG. 3A, taken along line C–C'.

FIG. 3D is a cross-sectional view of the pick-up head shown in FIG. 3A, taken along line D—D.

DETAILED DESCRIPTION

Figure 1:
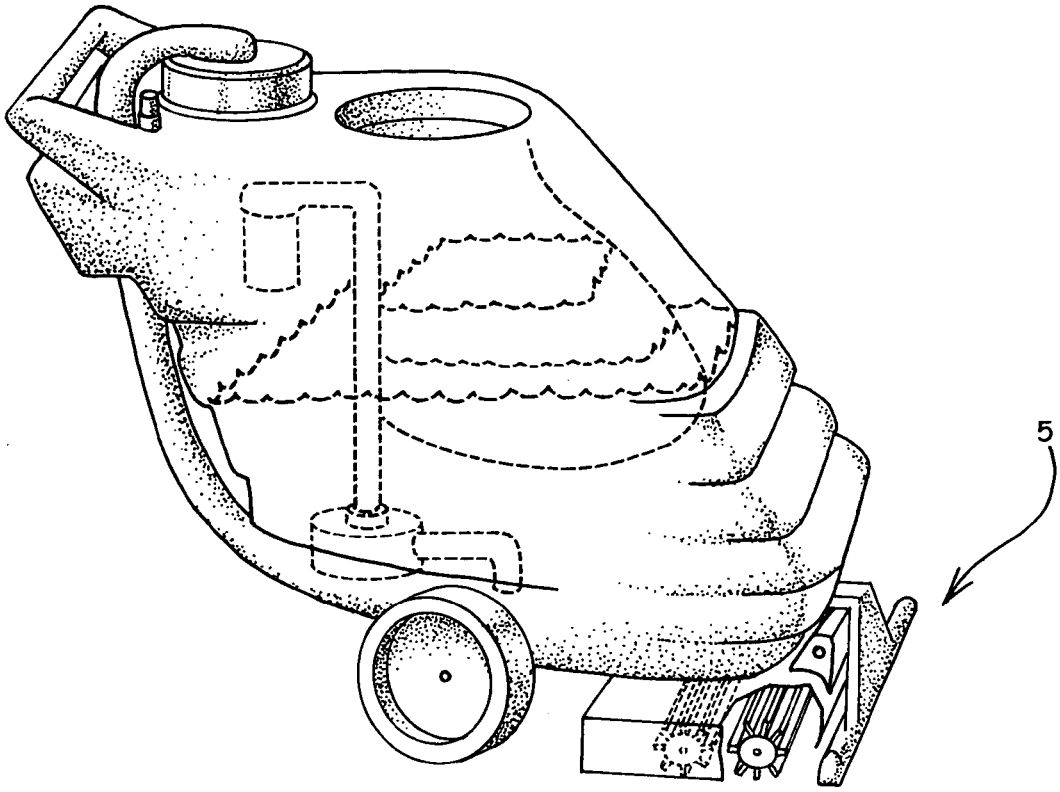
FIG. 1 is a perspective illustration of a known surface maintenance machine utilizing a high-profile vacuum pick-up head.

FIG. 1 illustrates a conventional surface maintenance machine particularly suitable for cleaning carpeted areas. A typical high-profile vacuum pick-up head 5 is used to extract soiled cleaning solution from the carpet after the cleaning solution has been applied to the carpet. Additional details of an extractor machine which may utilize aspects of the present invention is disclosed in U.S. Pat. No. 4,956,891, to Wulff, and incorporated in its entirety by reference herein.

Figure 2A:
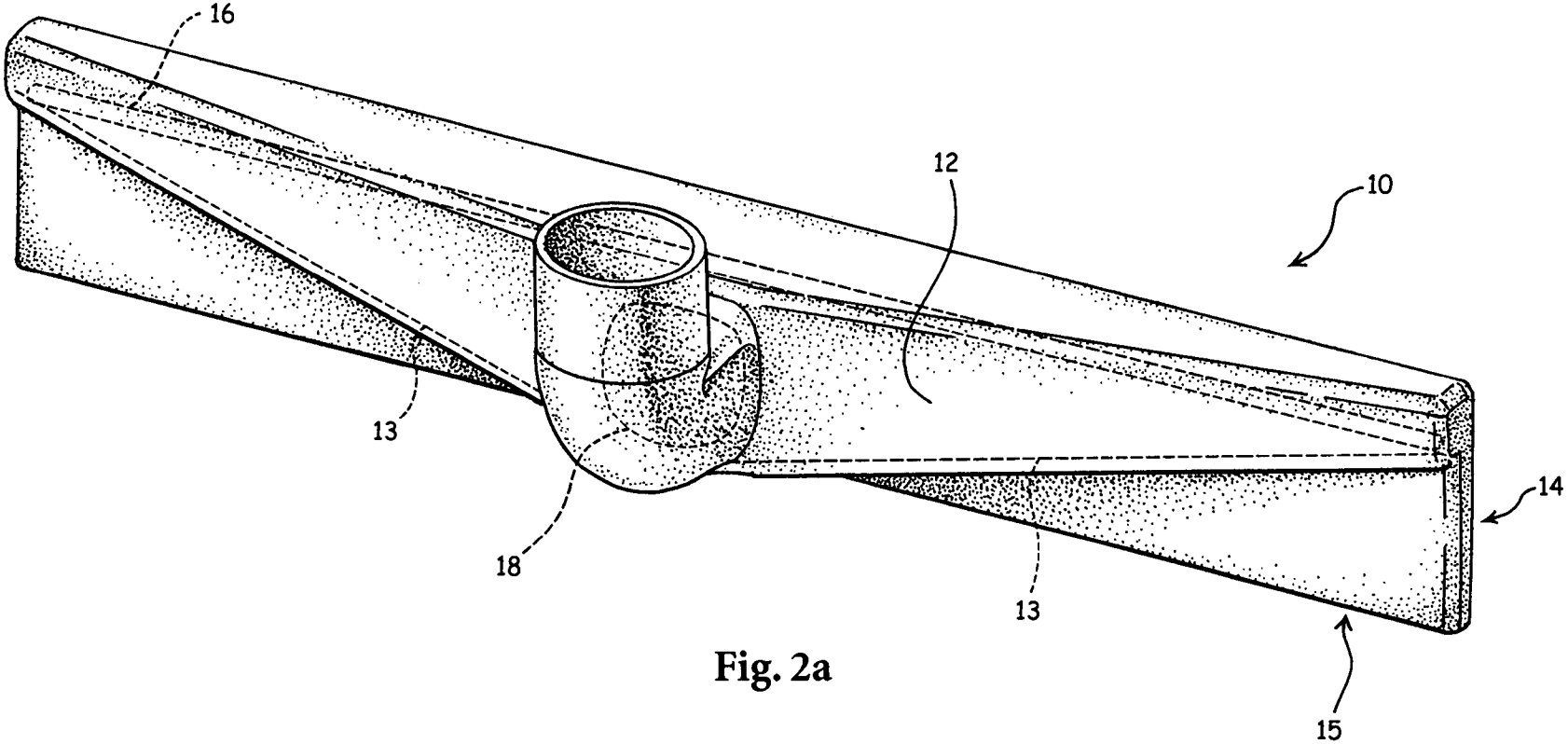
FIG. 2A is a front elevational view of one embodiment of the pick-up head of the present invention.

FIG. 2A shows a front elevational view of one embodiment of the low-profile pick-up head 10 of the present invention. Pick-up head 10 includes enclosed area or vacuum chamber 12, pick-up nozzle 14, and outlet orifice 18, which can be connected to a vacuum source, not shown.

Vacuum chamber 12 preferably and optionally includes a sloping bottom surface 13 which preferably slopes so that fluid flows toward outlet orifice 18, even when the vacuum source has been turned off.

Nozzle 14 includes a pick-up slot 15 and a upper end 16. Upper end 16 is preferably positioned within vacuum chamber 12 so that end 16 is located above bottom surface 13. As shown in FIGS. 3*b*, 3*c* and 3*d*, upper end 16 is similarly configured to pick-up slot 15 e.g. it is slot-shaped. Nozzle 14 is defined between a pair of generally parallel and planar walls 17. Outlet orifice 18 is shown at the back and center of head 10 in this embodiment, although other positions are contemplated by the present invention.

Figure 7:
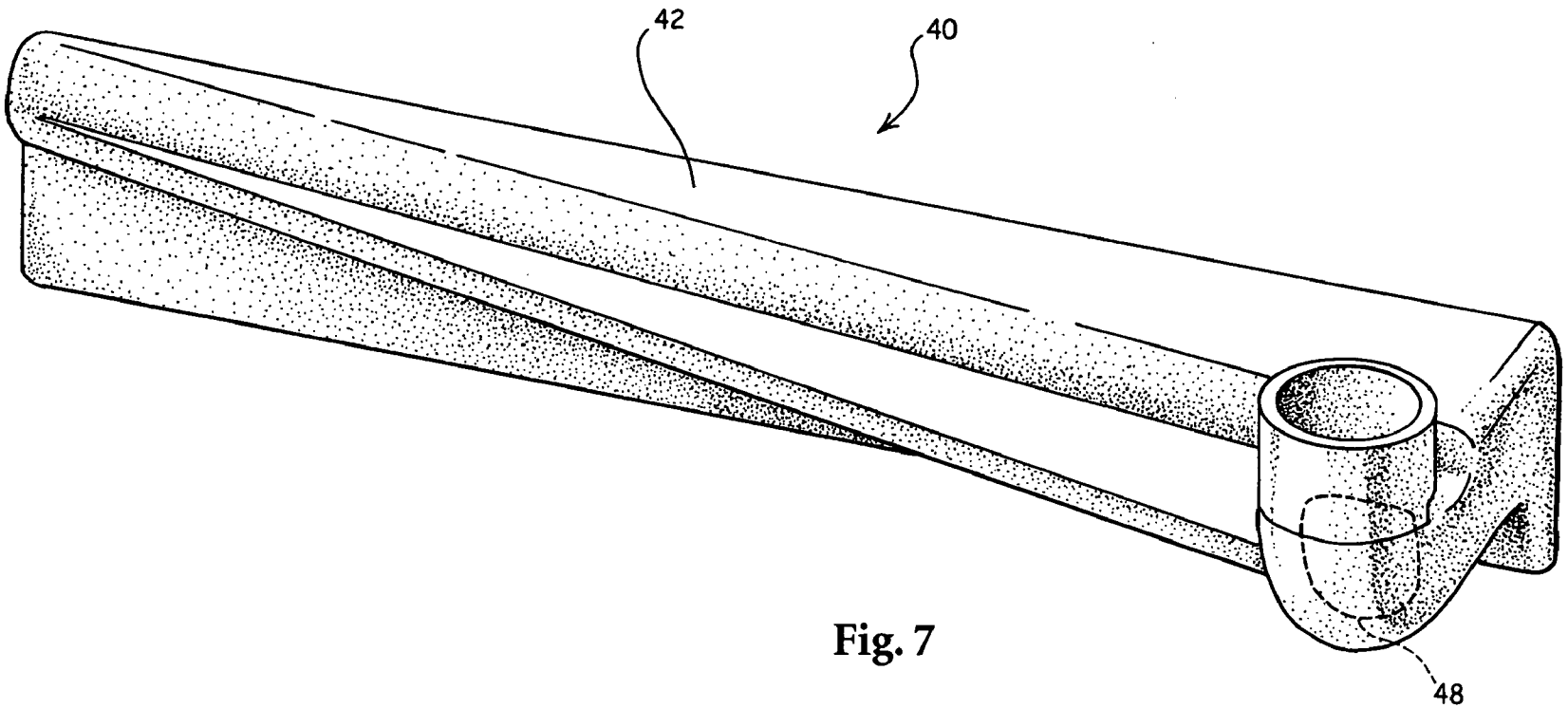
FIG. 7 is a front elevational view of another embodiment of the pick-up head of the present invention.
Figure 8:
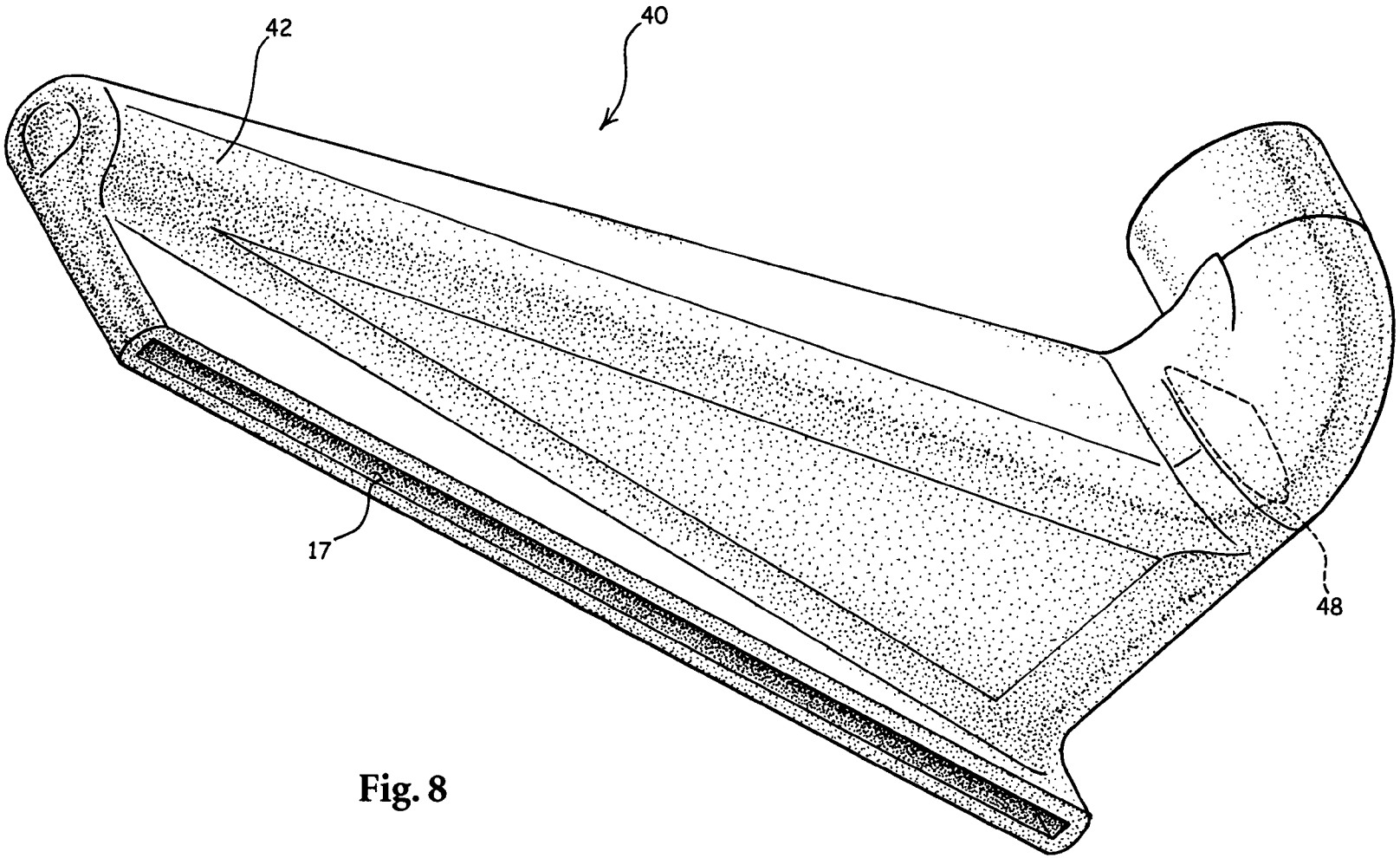
FIG. 8 is a bottom elevational view of the pick-up head shown in FIG. 7.

Outlet orifice 18 is preferably positioned near bottom surface 13, and can be located anywhere along the width of head 10. FIGS. 7 and 8 show an embodiment of the low profile pick-up head 40 of the present invention in which outlet orifice 48 is positioned at one end of head 40. The outlet orifice is connected to a vacuum source, not shown, to pull cleaning solution from the carpet surface through the pick-up nozzle, into the vacuum chamber and through the outlet orifice to a collection system, also not shown.

Figure 2B:
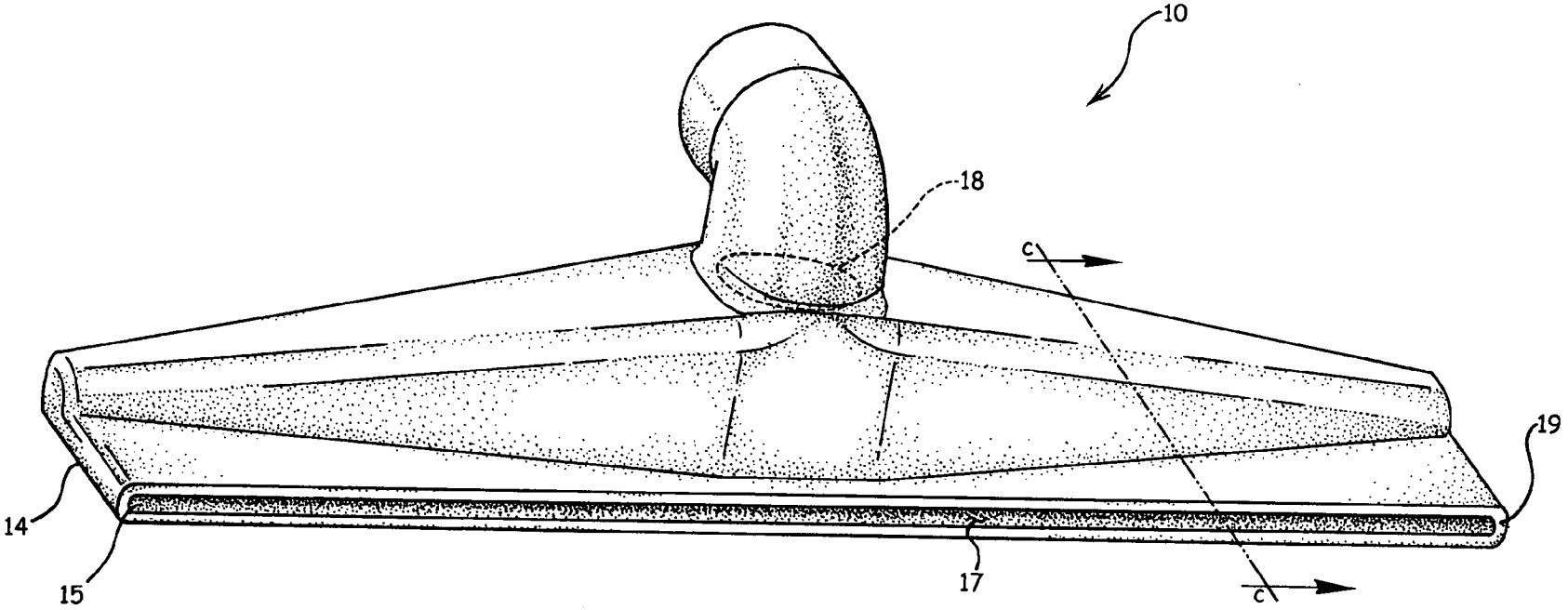
FIG. 2B is a bottom elevational of the pick-up head shown in FIG. 2A.

FIG. 2B is another perspective view of pick-up head 10. As will be described hereinafter, the cross-sectional area of vacuum chamber 12 may vary with the distance from outlet orifice 18. The shaded portion of slot 15 defines the slot surface area taken from line C–C' to nozzle edge 19, as will be described in more detail below.

FIGS. 3B through 3D show cross-sectional views of pickup head 10 taken at various points along the width of head 10 as shown in FIG. 3A. In this embodiment, the cross-sectional area of vacuum chamber 12 varies depending on the distance from outlet orifice 18, and generally decreases as the distance from the outlet orifice 18 and vacuum source increases.

In one preferred embodiment, the cross-sectional area of vacuum chamber 12 taken at a specific location along the vacuum chamber is at least two times the slot surface area at that location. The slot surface area is defined as the open area of the slot in contact with the surface being cleaned, taken from the nearest outer edge 19 of pick-up head 10 to a specified location, such as lines B–B', C–C' or D–D' in FIGS. 3B, 3C and 3D. For example, referring to FIGS. 2 and 3C, the cross-sectional area of vacuum chamber 12 taken at line C–C' of FIG. 3A is at least twice the slot surface area defined as the product of D1 and D2 in FIGS. 3C and 3A respectively. This relationship facilitates a substantially uniform vacuum along the entire width of pick-up head 10. One benefit of a uniform vacuum across the extractor width is uniform soiled solution recovery from the carpet. Vacuum chamber 12 can be of other size and dimension, and preferably has a cross-sectional area sufficient to provide a substantially uniform vacuum across the entire width of pick-up head 10.

By utilizing vacuum chamber 12 to distribute the vacuum pressure substantially uniformly along the width of pick-up head 10, thereby improving the vacuum pick-up efficiency of pick-up head 10, it is possible to make head 10 wider without the need to make it substantially taller (or "high-profile") as in other systems. Conventional high-profile pick-up heads generally have vortices which suspend a volume of soiled solution. Upon deactivation of the vacuum, the suspended soiled solution drops onto the carpet, reducing the efficiency of the extraction process. The low-profile pick-up head 10 of the present invention, because of its lower overall profile and vacuum chamber design, does not entrap as much soiled solution as in standard high-profile systems, and thereby reduces or eliminates soiled solution flowing back onto the carpet when the vacuum is deactivated. The low-profile head may also be useful for drying carpets in hard to reach areas that cannot be readily accessed by taller high-profile pick-up heads.

Referring to FIGS. 7 and 8, and as described previously, the cross-sectional area of vacuum chamber 42 varies along the width of head 40, and generally decreases as the distance from outlet 48 increases.

Figure 4:
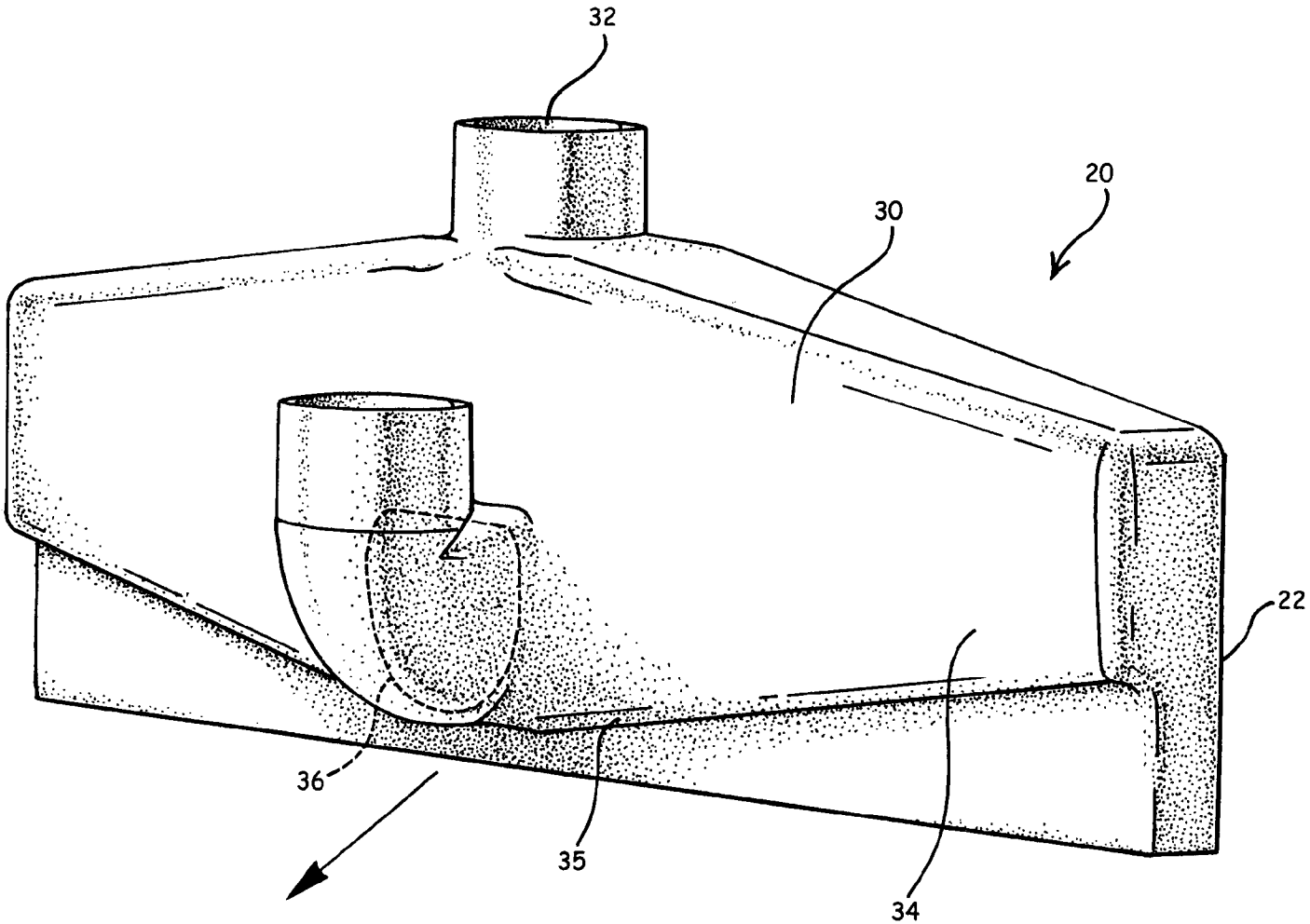
FIG. 4 is a front elevational view of an embodiment of the push-pull head of the present invention.
Figure 5:
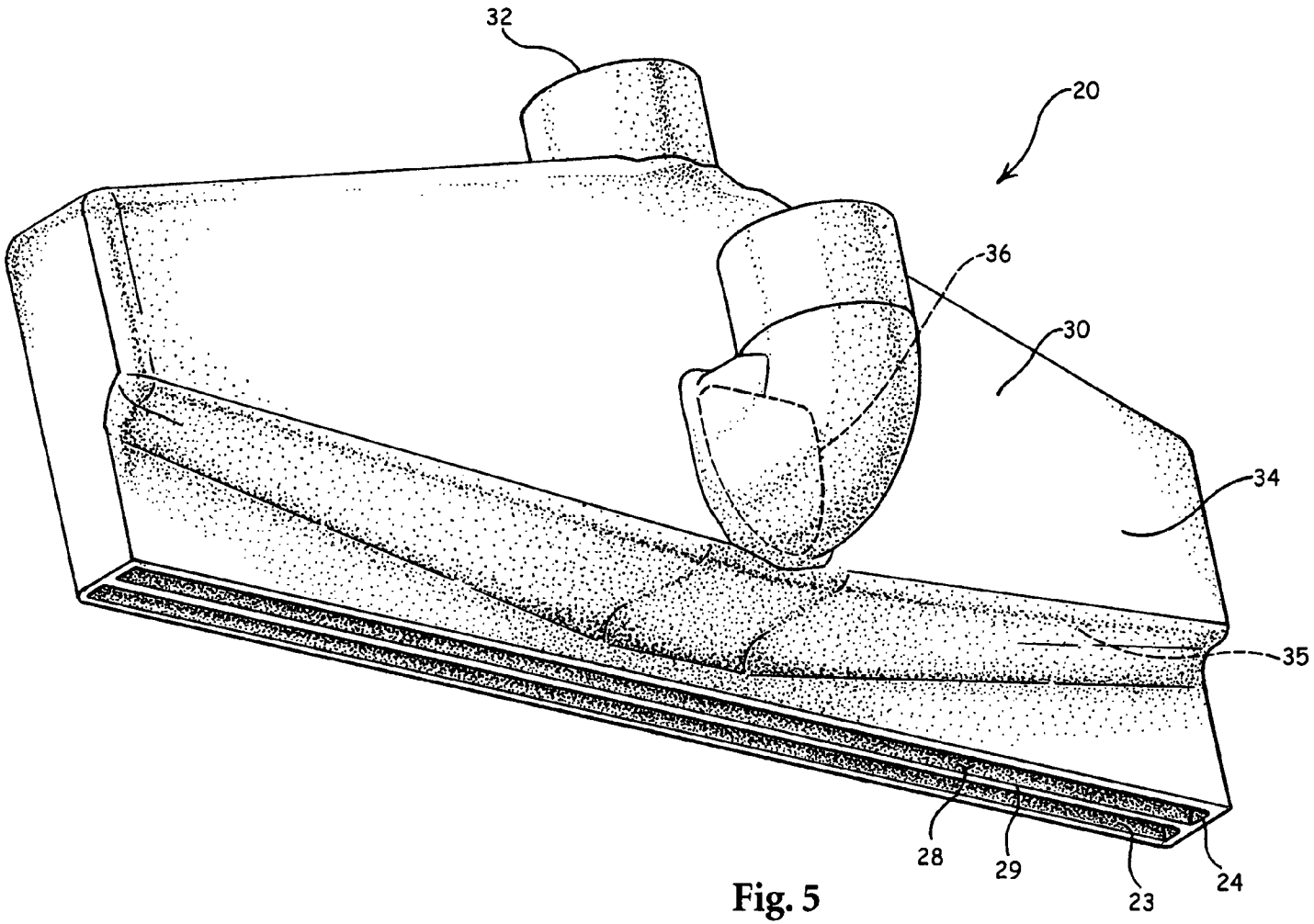
FIG. 5 is a bottom elevational view of the push-pull head shown in FIG. 4.

FIGS. 4 through 6 illustrate another embodiment of the present invention. FIG. 4 is a perspective view of a low-profile push-pull head 20 which includes two nozzles, an exhaust nozzle 22 and a pick-up nozzle 24. The exit slot 23 of exhaust nozzle 22 and the pick-up slot 25 of pick-up nozzle 24 are in contact with the carpet or other surface during operation.

Nozzles 22 and 24 are separated by a septum or wall 28. Edge 29 of septum 28 can be flush with nozzle ends 23 and 25, but preferably extends beyond slots 23 and 25. If edge 29 extends slightly beyond slots 23 and 25, the performance of pick-up head 20 is improved compared to a flush alignment. Preferably, septum edge 29 extends by between about 0 to about 0.05 inches beyond slots 23 and 25, and more preferably edge 29 extends by about 0.03 inches beyond slots 23 and 25.

Exhaust nozzle 22 is in fluid communication with positive pressure chamber 30 (or the "push" chamber). Pressure chamber 30 has an inlet orifice 32, which connects chamber 30 to a blower or vacuum fan outlet (not shown). Air is forced into chamber 30 and out onto the carpet through exit slot 23. Pressurized air leaving exit slot 23 facilitates removal of soiled solution from the carpet by pneumatically forcing some of the soiled solution toward pick up slot 25. Through this process, more cleaning solution can be removed from the surface, and the carpet drying time is shortened.

Pick-up nozzle 24 extracts the cleaning solution by applying a vacuum to the carpet. Nozzle 24 is connected to vacuum chamber 34 (or the "pull" chamber) having an outlet orifice 36 to which a vacuum source (not shown) is connected. Vacuum chamber 34 has a bottom surface 35 which preferably slopes towards outlet orifice 36 to facilitate cleaning solution removal from head 20. Pick-up nozzle 24, vacuum chamber 34, and outlet orifice 36 are configured similar to the embodiment shown in FIGS. 2A–3D. Due to the overall low profile of push-pull head 20, and the slope of vacuum chamber bottom surface 35, when the vacuum is turned off, substantially no cleaning solution trickles back out of nozzle 24 onto the carpet.

Figures 6A, 6B, 6C, 6D:
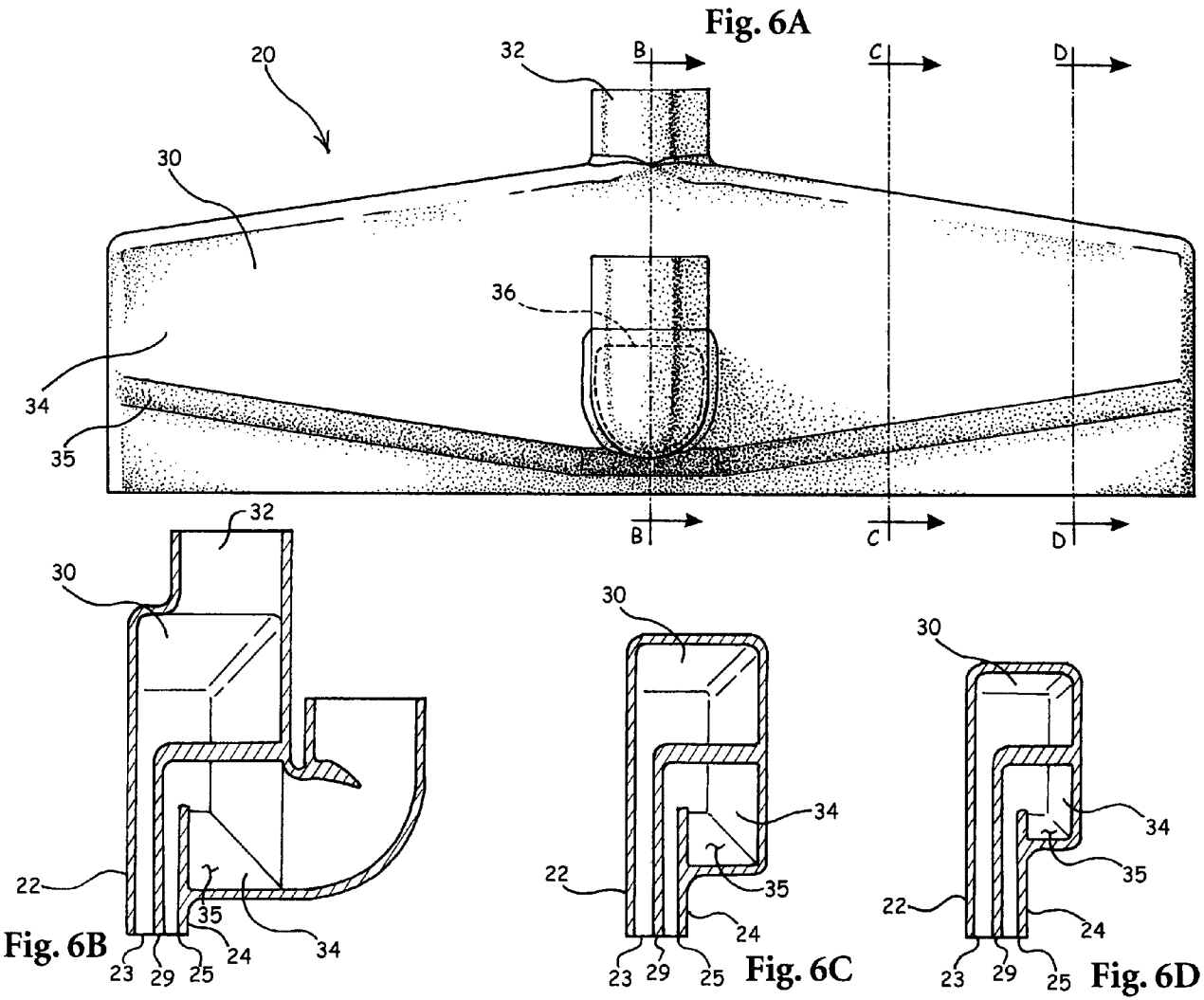
FIG. 6A is a front view of the push-pull head shown in FIG. 4.
FIG. 6B is a cross-sectional view of the pick-up head shown in FIG. 6A, taken along line B–B'.
FIG. 6C is a cross-sectional view of the pick-up head shown in FIG. 6A, taken along line C–C'.
FIG. 6D is a cross-sectional view of the pick-up head shown in FIG. 6A, taken along line D–D'.

FIG. 5 is another perspective view of push-pull head 20 of the present invention. As can be seen, the cross-sectional areas of chambers 30 and 34 varies with the distance from inlet orifice 32 or outlet orifice 36, respectively, in a relationship similar to the embodiments described in FIGS. 2A–3D. FIGS. 6B–6D show the increasing cross-sectional areas of chambers 30 and 34 with increasing slot surface areas taken at lines B–B', C–C' and D–D' of FIG. 6A.

In the direction of motion across a carpet or other surface, as indicated by the arrow in FIG. 4, the pickup nozzle 24 is preferably positioned on the leading edge of head 20, with exhaust nozzle 22 positioned behind nozzle 24. This configuration allows cleaning solution blown off and out of the carpet surface to be picked up by nozzle 24 with little or no spraying of cleaning solution beyond the reach of nozzle 24. Although this is the preferred embodiment, alternate embodiments are contemplated by the present invention. Such embodiments include having exhaust nozzle 22 at the leading edge of head 20 with pickup nozzle 24 positioned behind it. Other alternate embodiments include a plurality of exhaust nozzles and/or pickup nozzle in various configurations relative to each other and the leading edge of push-pull head 20.

Although FIGS. 4–6 show inlet orifice 32 and outlet orifice 36 positioned in a vertical alignment, any positioning of orifices 32 and 36 with respect to each other is contemplated by the present invention. Preferably, outlet orifice 36 is positioned near the bottom of head 20 to maximize the amount of soiled solution removed from the head and in doing so prevents cleaning solution from draining back out of the head 20 onto the carpet when the vacuum source is turned off.

Figure 9:
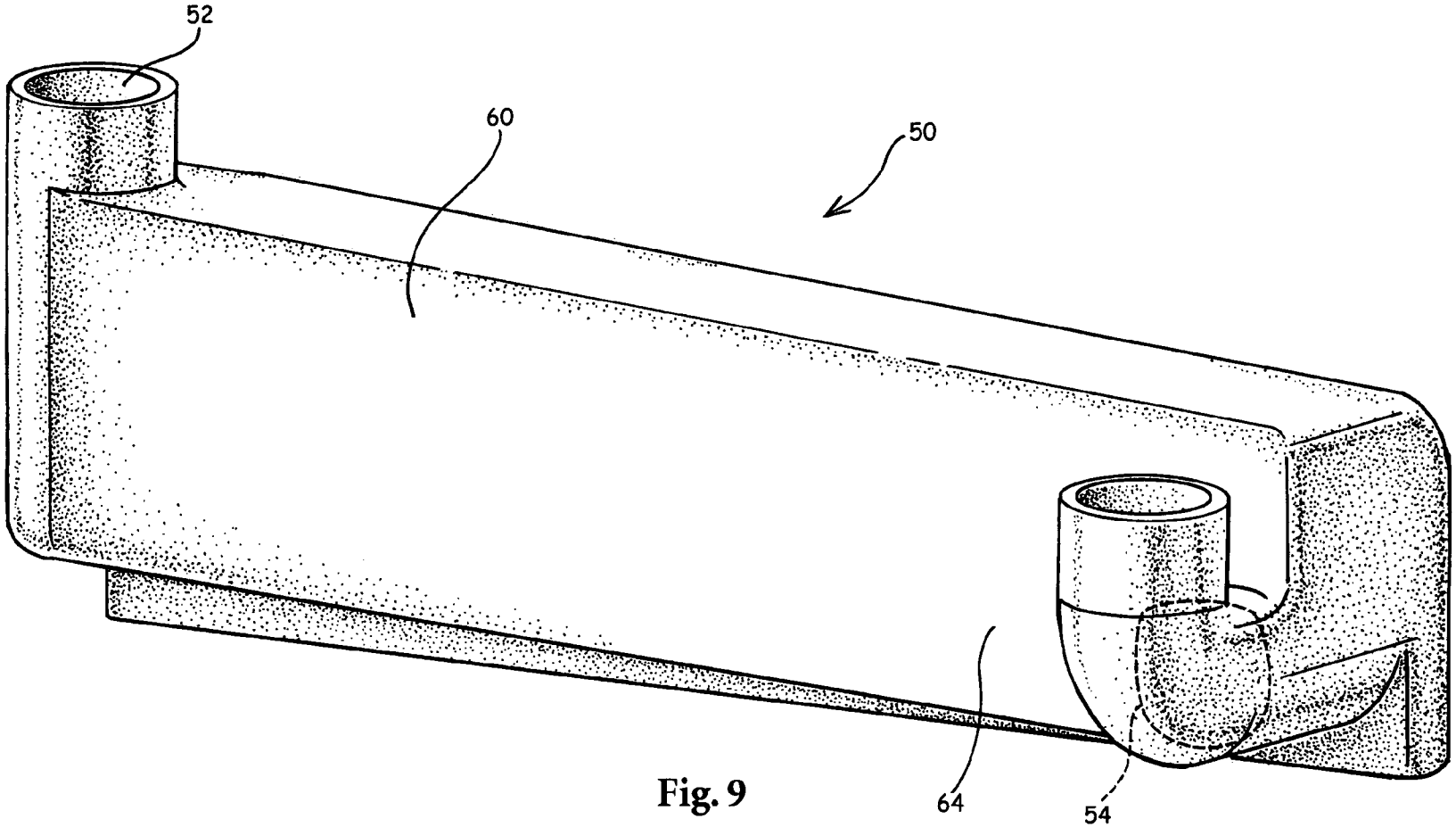
FIG. 9 is a front elevational view of another embodiment of the push-pull head of the present invention.
Figure 10:
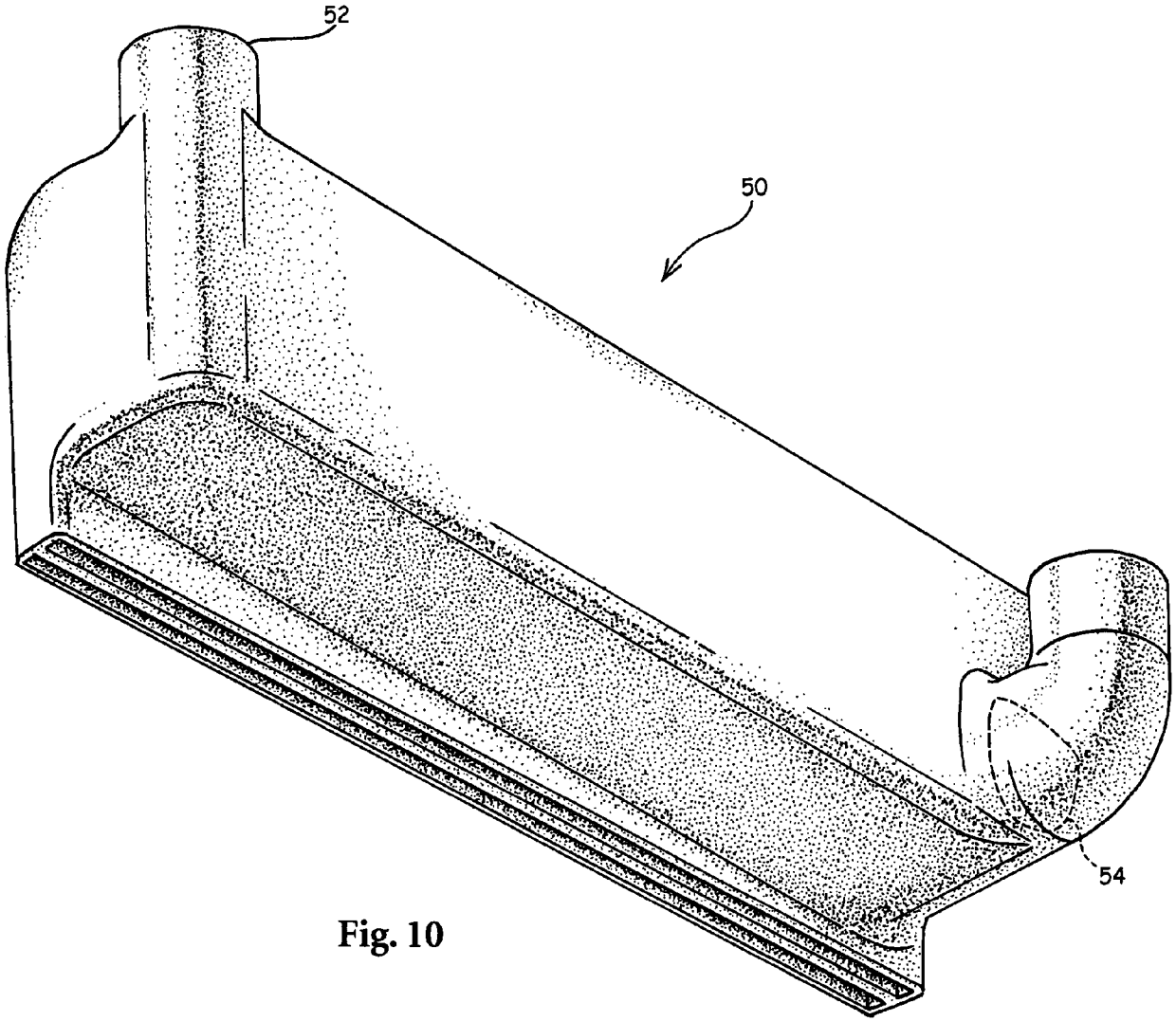
FIG. 10 is a bottom elevational view of the push-pull head shown in FIG. 9.

FIGS. 9 and 10 show an embodiment of the low profile push-pull head 50 of the present invention, in which inlet orifice 52 is positioned at one end of head 50 and outlet orifice 54 is positioned at the opposite end of head 50. As described previously, the cross-sectional areas of chambers 60 and 64 varies as the distance from the respective orifices 52 and 54 increases. In general, the cross-sectional area of each chamber decreases as the distance from the orifice increases. In one preferred embodiment, the cross-sectional area of the chamber is approximately two times the slot surface area at the same point on the head, as described previously.

EXAMPLE

The recovery rate of the low-profile push-pull pick-up head of the present invention was compared to a standard, high-profile pick-up head on a Power Eagle extractor, Model Number 1016, manufactured by Tennant Company. The recovery rate was defined as a ratio, expressed as a percentage of the amount of solution extracted from the surface to the amount of solution applied to the surface. A higher recovery rate results in a drier carpet since less water remains in the carpet after using the extractor.

The extractor was used on a test table carpeted with level loop carpeting at two different speeds, measured in inches per second, with each type of pick-up head. The extractor was also tested on an actual office floor carpeted with a different level loop carpeting at a higher speed. A measured volume of water was poured onto each test surface, the extractor was used on the surface, and the volume of water removed by the extractor was compared to the initial volume of water applied to the surface. The average results are shown in the following table:

TABLE I

| Percent Water Recovered by Extractor | | |
|---|---|---|
| Testing Conditions | Standard pick-up head | Push-pull pick-up head |
| Test Table, 14.1 in/sec | 37% | 41% |
| Test Table, 5.6 in/sec | 67% | 70% |
| Office Floor, 12 in/sec | 57% | 67% |

As seen in these results, the low-profile push-pull pick-up head has an improved recovery rate in comparison to the standard pick-up head.

The foregoing is intended as a description of various embodiments of the present invention, and is not intended to limit the invention in any way. The present invention encompasses numerous modifications and variations of the embodiments described herein that will be apparent to those of skill in the art The present invention is clearly and specifically defined by the following claims.

What is claimed is:

1. A fluid recovery device for use in conjunction with a vacuum source to remove a fluid from a surface, said fluid recovery device comprising:

a vacuum chamber having a bottom surface and having an enclosed interior volume;

an elongated nozzle having an inlet and an outlet, said nozzle being a conduit between ambient air and the vacuum chamber, said inlet adapted to be placed in contact with the surface, said nozzle outlet being provided above the bottom surface of the vacuum chamber;

an upwardly extending wall between the bottom surface and the nozzle outlet, said wall blocking a flow of recovered fluid from the bottom surface back into the nozzle; and an outlet orifice being selectively coupled to the vacuum source so that fluid is removed from the surface through the nozzle inlet and through the vacuum chamber, wherein the bottom surface is sloped toward to the outlet orifice to facilitate fluid flow toward the outlet orifice, and wherein a cross sectional area of the vacuum chamber decreases as the distance from the outlet orifice increases.

2. The fluid recovery device of claim 1, said nozzle outlet being provided above the bottom surface of the vacuum chamber.

3. The fluid recovery device of claim 1, wherein an area of the vacuum chamber taken in a cross section aligned generally transverse to the nozzle is at least two times a slot area comprising an open area of the nozzle measured from an end.

4. The fluid recovery device of claim 1, wherein the nozzle comprises a pair of generally parallel walls between the inlet and the outlet.

5. The fluid recovery device of claim 1, wherein the outlet orifice is provided at a middle portion of the device.

6. A fluid recovery device for use in conjunction with a vacuum source to remove a fluid from a surface, said fluid recovery device comprising:

a vacuum chamber having a bottom surface and having an enclosed interior volume;

an elongated nozzle having an inlet and an outlet said nozzle being a conduit between ambient air and the vacuum chamber, said inlet adapted to be placed in contact with the surface; and an outlet orifice, said outlet orifice being selectively coupled to the vacuum source so that fluid is removed from the surface through the nozzle inlet and through the vacuum chamber, wherein the bottom surface of the vacuum chamber is sloped downwardly toward the outlet orifice during operation, and wherein a cross sectional area of the vacuum chamber decreases as the distance from the outlet orifice increases.

7. A fluid recovery device for use in conjunction with a vacuum source to remove a fluid from a surface, said fluid recovery device comprising:

a vacuum chamber having a bottom surface and having an enclosed interior volume;

an elongated nozzle having an inlet and an outlet, said nozzle being a conduit between ambient air and the vacuum chamber, said inlet adapted to be placed in contact with the surface; and an outlet orifice, said outlet orifice being selectively coupled to the vacuum source so that fluid is removed from the surface through the nozzle inlet and through the vacuum chamber, and wherein the outlet orifice is provided at a side portion of the device.

8. A fluid recovery device for use with a vacuum source and a pressurized air source to remove fluid from a surface, said fluid recovery device comprising:

a positive air pressure nozzle having an outlet slot adapted to be placed against a surface from which fluid is to be removed;

a positive air pressure inlet orifice, said positive air pressure inlet orifice being coupled to the pressurized air source so that pressurized air is directed out of the outlet slot of the positive air pressure nozzle and toward the surface;

a vacuum chamber and a vacuum nozzle having an inlet slot aligned relative to the outlet slot of the positive air pressure nozzle and a nozzle outlet provided above a bottom surface of the vacuum chamber, said vacuum nozzle being in fluid communication with the vacuum source so that fluid is removed from the surface through the vacuum nozzle, and an upwardly extending wall between the bottom surface and the nozzle outlet, said wall blocking a flow of recovered fluid from the bottom surface back into the nozzle, wherein the vacuum chamber has a cross sectional area which decreases as a distance from the outlet orifice increases.

9. The fluid recovery device of claim 8, wherein the positive air pressure nozzle is positioned adjacent to the vacuum nozzle.

10. The fluid recovery device of claim 9, wherein the positive air pressure nozzle and the vacuum nozzle are divided by a septum.

11. The fluid recovery device of claim 8, wherein the cross-sectional area is at least two times a vacuum slot surface area comprising an open area of the vacuum nozzle measured from an end.

12. The fluid recovery device of claim 8, wherein the vacuum nozzle comprises a pair of generally parallel walls between the inlet slot and the upper outlet.

13. The fluid recovery device of claim 8, wherein the vacuum outlet orifice is provided at a middle portion of the device.

14. A fluid recovery device for use with a vacuum source and a pressurized air source to remove fluid from a surface, said fluid recovery device comprising:

a positive air pressure nozzle having an outlet slot adapted to be placed against a surface from which fluid is to be removed;

a positive air pressure inlet orifice, said positive air pressure inlet orifice being coupled to the pressurized air source so that pressurized air is directed out of the outlet slot of the positive air pressure nozzle and toward the surface;

a vacuum nozzle having an inlet slot aligned relative to the outlet slot of the positive air pressure nozzle, said vacuum nozzle being in fluid communication with the vacuum source so tat fluid is removed from the surface through the vacuum nozzle, and wherein the bottom surface of the vacuum chamber is sloped toward the vacuum outlet orifice during operation, and wherein a cross sectional area of the vacuum chamber decreases as the distance from the outlet orifice increases.

15. A fluid recovery device for use with a vacuum source and a pressurized air source to remove fluid from a surface, said fluid recovery device comprising:

a positive air pressure nozzle having an outlet slot adapted to be placed against a surface from which fluid is to be removed;

a positive air pressure inlet orifice, said positive air pressure inlet orifice being coupled to the pressurized air source so that pressurized air is directed out of the outlet slot of the positive air pressure nozzle and toward the surface;

a vacuum nozzle having an upper outlet above a bottom surface and an inlet slot aligned relative to the outlet slot of the positive air pressure nozzle, said vacuum nozzle being in fluid communication with the vacuum source so that fluid is removed from the surface through the vacuum nozzle, and wherein the upper outlet of the vacuum nozzle is an elongate slot, and wherein a cross sectional area of the vacuum chamber decreases as the distance from an outlet aperture increases.

16. A fluid recovery device for use with a vacuum source and a pressurized air source to remove fluid from a surface, said fluid recovery device comprising:

a positive air pressure nozzle having an outlet slot adapted to be placed against a surface from which fluid is to be removed;

a positive air pressure inlet orifice, said positive air pressure inlet orifice being coupled to the pressurized air source so that pressurized air is directed out of the outlet slot of the positive air pressure nozzle and toward the surface;

a vacuum nozzle having an inlet slot aligned relative to the outlet slot of the positive air pressure nozzle, said vacuum nozzle being in fluid communication with the vacuum source so that fluid is removed from the surface through the vacuum nozzle, and wherein the vacuum outlet orifice is provided at a side portion of the device.

17. A method for drying a surface, comprising the steps of:

providing a fluid recovery device, said fluid recovery device including a vacuum chamber, a nozzle having an elongated inlet slot and an upper outlet, said nozzle being in fluid communication with the vacuum chamber, and an outlet orifice being selectively coupled to the vacuum source so that fluid is removed from the surface through the nozzle and through the vacuum chamber, said upper outlet provided above a bottom surface of the vacuum chamber, and an upwardly extending wall positioned between the bottom surface and the upper outlet, said wall blocking a flow of recovered fluid from the bottom surface back into the nozzle, wherein the bottom surface is sloped toward to the outlet orifice to facilitate fluid flow toward the outlet orifice, and wherein the vacuum chamber has non-constant cross sectional areas taken in planes which generally perpendicular to the elongated inlet slot said cross sectional areas decreasing as the distance from the outlet orifice increases;

positioning the fluid recovery device on the surface;

selectively coupling a vacuum source to the outlet orifice to provide a substantially uniform vacuum across the nozzle; and removing cleaning solution from the surface by moving the fluid recovery device across the surface to extract fluid from surface.

18. The method of claim 17, further comprising the step providing an exhaust nozzle proximate to the nozzle and activating a blower connected to the exhaust nozzle to direct fluid from the surface towards the nozzle.

19. A fluid recovery device for removing fluid from a floor surface wit a vacuum collection system, said fluid recovery device comprising:

a nozzle defining an elongated slot having an inlet slot and an upper outlet, said upper outlet provided above a bottom surface of the vacuum chamber, an upwardly extending wall positioned between the bottom surface and the upper outlet, said wall blocking a flow of fluid from the bottom surface back into the nozzle;

an vacuum chamber in fluid communication with the nozzle, said vacuum chamber having a cross sectional area taken in a plane generally perpendicular to the elongated slot which varies across a length of the nozzle; and an outlet aperture in fluid communication with the vacuum collection system, wherein the cross sectional area of the vacuum chamber decreases as the distance from the outlet aperture increases, and wherein the bottom surface is sloped toward to the outlet aperture to facilitate fluid flow toward the outlet aperture.

20. The fluid recovery device of claim 19, wherein the nozzle includes a pair of generally parallel walls.

21. A fluid recovery device for removing fluid from a floor surface with a vacuum collection system, said fluid recovery device comprising:

a nozzle defining an elongated slot;

an enlarged vacuum chamber in fluid communication with the nozzle, said enlarged vacuum chamber having non-constant cross sectional areas taken in planes which are generally perpendicular to the elongated slot; and an outlet aperture in fluid communication with the vacuum system, wherein the cross sectional area of the enlarge vacuum chamber area decreases as the distance increases from the outlet aperture, and wherein the nozzle includes an upper outlet and the enlarged vacuum chamber area includes a bottom surface, and wherein the upper outlet of the nozzle is provided above the bottom surface, wherein the bottom surface is sloped toward to the outlet aperture to facilitate fluid flow toward the outlet aperture.

* * * * *

UNITED STATES PATENT AND TRADEMARK OFFICE

CERTIFICATE OF CORRECTION

PATENT NO. : 7,059,013 B2
APPLICATION NO. : 10/236746
DATED : June 13, 2006
INVENTOR(S) : Larry D. Wydra et al.

It is certified that error appears in the above-identified patent and that said Letters Patent is hereby corrected as shown below:

Column 8, line 18, delete “tat” and insert --that--;

Column 9, line 28, delete “wit” and insert --with--;

Column 10, line 27, delete “area”.

Signed and Sealed this

Twenty-first Day of November, 2006

JON W. DUDAS
*Director of the United States Patent and Trademark Office*